US005501576A

United States Patent [19]

Monroe

[11] Patent Number: 5,501,576

[45] Date of Patent: Mar. 26, 1996

[54] STATIC EFFICIENCY ENHANCER FOR AXIAL FANS

[75] Inventor: Robert C. Monroe, Houston, Tex.

[73] Assignee: Hudson Products Corporation, Houston, Tex.

[21] Appl. No.: 443,606

[22] Filed: May 18, 1995

Related U.S. Application Data

[60] Continuation of Ser. No. 243,359, May 16, 1994, abandoned, which is a division of Ser. No. 109,888, Aug. 23, 1993, Pat. No. 5,328,335.

[51] Int. Cl.[6] ..... F01D 5/12

[52] U.S. Cl. ..... 416/239

[58] Field of Search ..... 416/239

[56] References Cited

U.S. PATENT DOCUMENTS

| | | | |
|---|---|---|---|
| 2,399,828 | 5/1946 | Roche | 416/239 |
| 2,427,166 | 9/1947 | Teeter et al. | 416/239 |
| 2,478,252 | 8/1949 | Dean | 416/239 |
| 2,592,214 | 4/1952 | Wallace | 416/239 |
| 2,637,403 | 5/1953 | Wallace | 416/239 |

FOREIGN PATENT DOCUMENTS

| | | | |
|---|---|---|---|
| 734008 | 4/1943 | Germany | 416/239 |

*Primary Examiner*—John T. Kwon
*Attorney, Agent, or Firm*—Robert J. Edwards

[57] ABSTRACT

A static efficiency enhancer for an axial fan having a hub and a plurality of blades extending radially outward from the hub, the enhancer comprising a plurality of airfoils connected to the hub and extending outwardly therefrom to provide additional air velocity at the periphery of the hub.

8 Claims, 2 Drawing Sheets

STATIC EFFICIENCY ENHANCER FOR AXIAL FANS

This is a continuation of application Ser. No. 08/243,359 filed May 16, 1994, now abandoned which is a division of Ser. No. 109,888, Aug. 23, 1993, Pat. No. 5,328,335..

FIELD AND BACKGROUND OF THE INVENTION

The present invention relates in general to axial fans, wherein blades are mounted on a hub which rotates to move an air stream from the fan inlet to its outlet along the rotating hub, and in particular to a new and useful method and apparatus for enhancing the static efficiency of axial fans.

In general, fan efficiency is the ratio of work expended to power required. Work can be roughly defined as the product of "Pressure times Airflow". Specifically it is:

$$\text{Total Efficiency} = \frac{\text{Total Pressure} \times ACFM}{6353 \times HP}$$

or $$\text{Static Efficiency} = \frac{\text{Static Pressure} \times CFM}{6356 \times HP}$$

Total pressure is defined as the sum of static pressure and velocity pressure. Static pressure is the suction or positive pressure, normally measured in inches of water, which the fan generates to create the differential pressure needed to move the air. Static pressure is useful work whereas velocity pressure is a parasitic loss and amounts to a loss of energy. The perfect fan would generate all static pressure, i.e., useful work, and experience no velocity pressure loss. One way to minimize velocity pressure is to maximize the net free area between the hub and the fan cylinder or housing. However, increasing the net free area encourages reverse air flow at the hub periphery, near the center of the fan, where the radial velocity of the fan blades is lowest. Thus, we are faced with the dilemma whereby a minimum hub diameter, e.g., 15% to 18% of fan diameter, is desirable to achieve low velocity pressure while a larger hub diameter, e.g., 25% to 30% of fan diameter, is needed to eliminate the negative air currents which occur as a result of low radial velocity of the fan blades near the center of the fan.

As noted earlier, one method of increasing static efficiency is to minimize the hub diameter to fan diameter ratio, i.e., the hub diameter should be small when compared to the fan diameter. Also, in order to perform efficiently, a fan blade must be designed to produce a uniform air velocity profile across the entire outlet area of the fan.

FIGS. 1, 2 and 3 depict the hub and fan blade designs associated with prior art axial fans.

FIG. 1 is a schematic view taken through the radius of a small diameter hub 16 mounted for rotation on an axis 18. A fan blade 14 is attached to the hub 16. A graph which plots fan radius against exit velocity in relative units is superimposed over the hub 16 and the fan blade 14. The fan blade 14 is designed to advance the air in the direction shown at A and to produce a uniform exit air velocity profile, as plotted at curve 12.

An ideal exit air velocity profile has a broad flat high velocity area corresponding to the length of fan blade 14 in the radial direction.

FIG. 2 is a schematic view, similar to FIG. 1, where the same reference numerals are used to designate the same or functionally similar parts as in FIG. 1. However, by contrast to FIG. 1, FIG. 2 depicts a lower efficiency fan blade design 24 which exhibits an exit air velocity profile 22, as determined from the experimental testing of many fans. The fan blade design 24 experiences a large loss of work and efficiency as shown by area 20 between the ideal velocity profile 12 and the actual velocity profile 22.

FIG. 3 is a schematic view, similar to FIG. 1, of still another fan blade design which includes a gap 26 between the hub 16 and the working portion of the fan blade 34. The gap 26 is covered by a seal disc 32 which extends to about 25% to 30% of the fan diameter and blocks some of the negative air vectors. However, the resultant increase in hub area decreases the net free area thereby increasing the velocity pressure which in turn increases the total pressure and reduces static efficiency since:

$$\text{Static Efficiency} = \frac{\text{Static Pressure} \times \text{Total Efficiency}}{\text{Total Pressure}}$$

SUMMARY OF THE INVENTION

The present invention provides a way to enhance static efficiency for axial fans by (a) allowing small hub diameter to fan diameter ratios, and (b) providing additional air velocity at the periphery of the hub to correct deficiencies in the exit air velocity profile. Consequently, the present invention is capable of achieving static pressure increases of 5% to 10%, thereby boosting static efficiency while reducing horsepower requirements with a corresponding savings of energy.

In accordance with the present invention, the static efficiency is increased by attaching an additional airfoil or bladelet to the hub or around the neck of each blade. The airfoils improve exit air velocity profiles and static efficiency in an advantageous and unexpected manner. A further object of the present invention is to provide a static efficiency enhancer for axial fans which is simple in design, rugged in construction and economical to manufacture.

The various features of novelty which characterize the invention are pointed out with particularity in the claims annexed to and forming a part of this disclosure. For a better understanding of the invention, its operating advantages and the specific objects attained by its uses, reference is made to the accompanying drawings and descriptive matter in which a preferred embodiment of the invention is illustrated.

DESCRIPTION OF THE PREFERRED EMBODIMENTS

Figure 4:
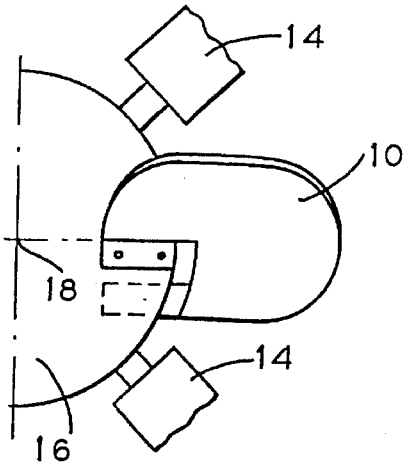
FIG. 4 is a partial front-elevation view of a hub of a fan embodying the present invention.
Figure 5:
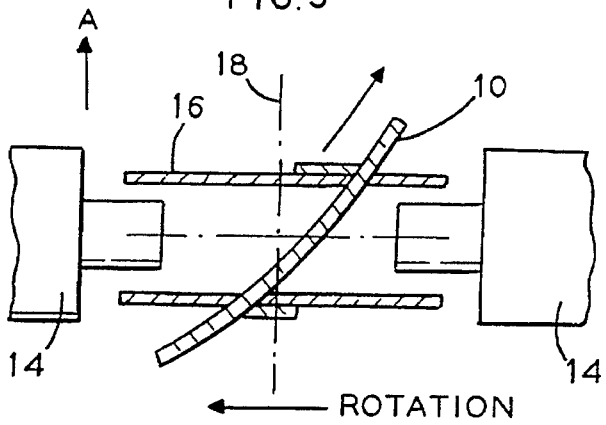
FIG. 5 is a sectional view of FIG. 4.
Figure 6:
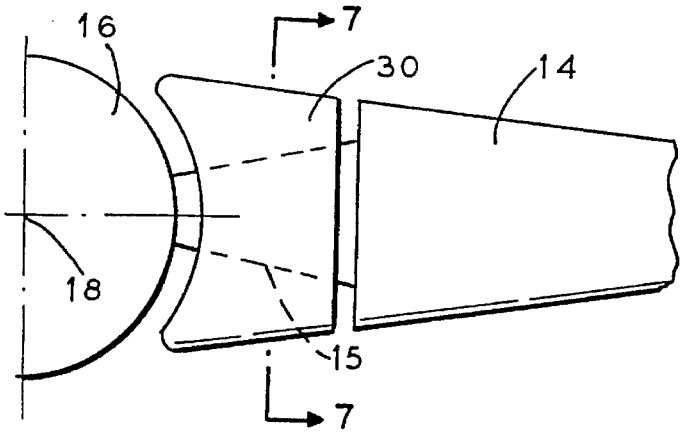
FIG. 6 is a partial front-elevation view of a hub, blade and airfoil according to an alternate embodiment of the invention.
Figure 8:
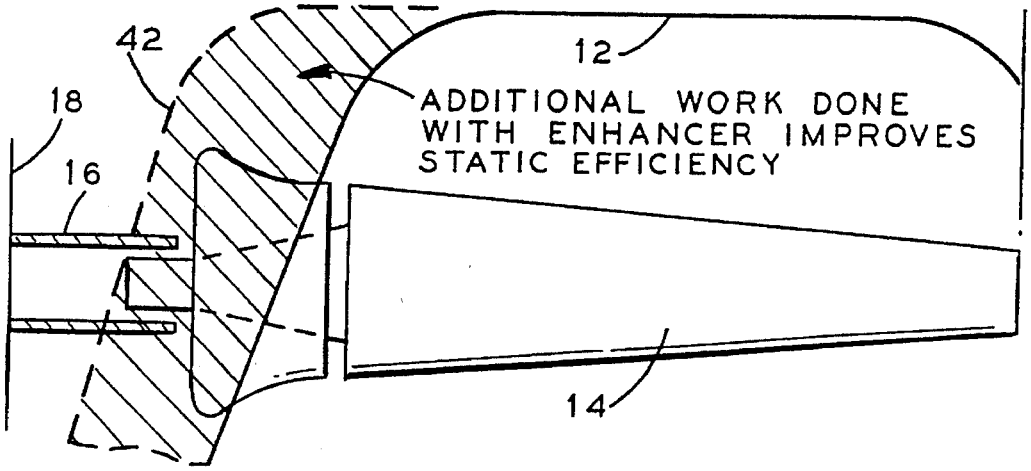
FIG. 8 is a radial-sectional view, similar to FIG. 1, but showing the enhanced efficiency of the present invention.

Referring to the drawings and, particularly, the invention as embodied in FIGS. 4 and 5 which comprises a static efficiency enhancer for axial fans having a hub 16 for rotation around a central axis 18 and including a plurality of fan blades 14 attached to and extending radially outward from the hub 16 which is flat and disc-shaped as clearly shown in FIGS. 5, 6 and 8.

According to the present invention, static efficiency enhancers in the form of airfoils or bladelets 10 are fixed to and extend radially outward from the hub 16. Each airfoil 10 is shaped as shown in FIG. 5. When the hub 16 is rotating, the fan blades 14 and the airfoils 10 advance the air in the direction shown at A in FIG. 5, with the airfoils 10 providing additional air velocity at the periphery of the hub 16, in the direction shown at A in FIG. 5, thereby enhancing the static efficiency of the fan.

The airfoils 10 are substantially shorter than the fan blades 14. The airfoils 10 are positioned between the fan blades 14 and extend outwardly from the hub 16 to about 25% to 30% of the fan diameter.

Figure 7:
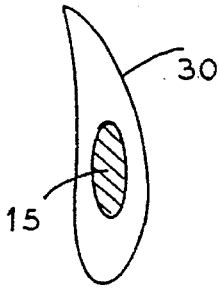
FIG. 7 is a sectional view taken along line 7—7 of FIG. 6.

A second embodiment of the invention is illustrated in FIGS. 6 and 7 and includes bladelets or airfoils 30 attached around the neck 15 of each fan blade 14. The sectional shape of airfoil 30 is shown in FIG. 7, and is designed to provide additional air velocity at the periphery of the hub 16, in the direction shown at A in FIG. 5, thereby enhancing the static efficiency of the fan.

Figure 1:
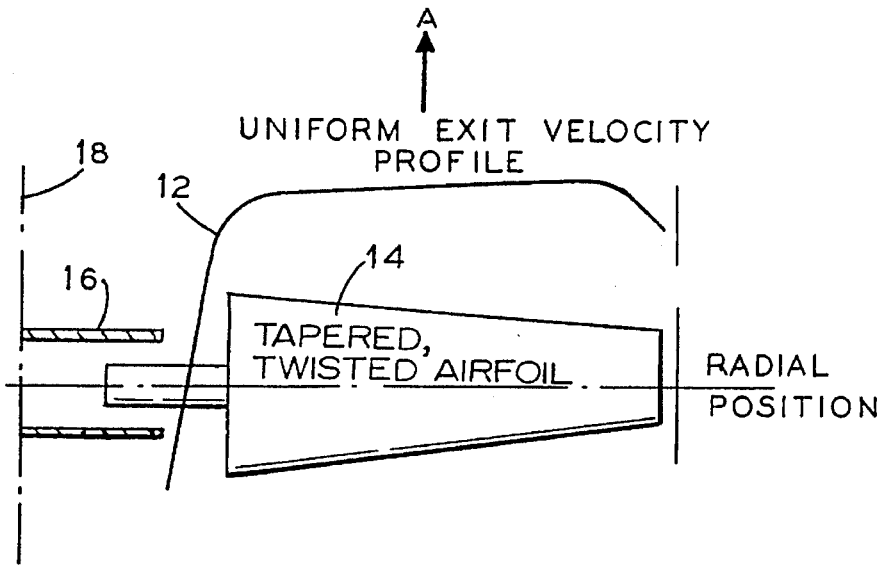
FIG. 1 (PRIOR ART)
FIG. 1 is a radial-sectional view of a hub and blade according to the prior art with a graph superimposed thereon and illustrating a velocity profile.
Figure 2:
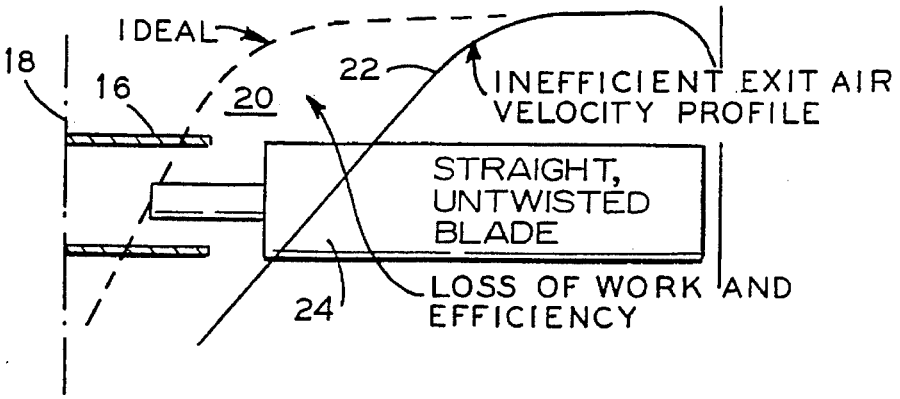
FIG. 2 (PRIOR ART)
FIG. 2 is a view, similar to FIG. 1, of an alternate embodiment of the prior art.
Figure 3:
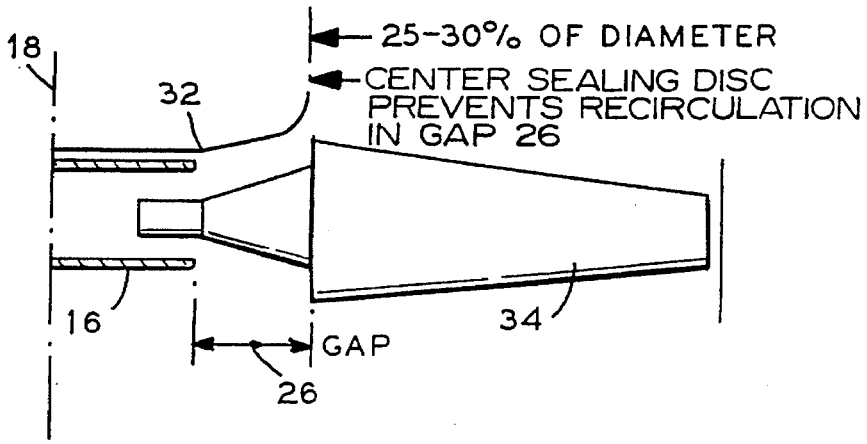
FIG. 3 (PRIOR ART)
FIG. 3 is a view, similar to FIG. 1, of still another embodiment of the prior art.

It should be noted that aerodynamic blade design dictates a rapid, e.g., exponential, increase in blade width on the inner area adjacent the hub, due to the decrease in angular velocity. Therefore, a drastic increase in width and airfoil angle of attack are needed at the inner radius of the blade in order to produce uniform air velocity. From a mechanical design standpoint, it is often not possible to do this and still provide a neck to hub attachment. The present invention overcomes this problem by using a conventional design for the neck to hub attachment and retrofitting an airfoil 30 over the neck 15. Each airfoil 30 is a molded element having an opening to receive the neck 15 and can be readily retrofitted to existing fans. During a retrofit operation, the fan blade 14 and neck 15 assembly is detached from the hub 16 and an airfoil 30 is slipped over and connected to the neck 15 and, thereafter, the fan blade 14 and neck 15 assembly is reattached to the hub 16. The fan blade 14 is typically fixed to the neck 15 during manufacture. The fan blade 14 and neck 15 assembly is installed in the hub 16 at an optimum operating pitch when fabricating the fan. When required, the fan blade 14 and neck 15 assembly can be detached from the hub 16. It should also be noted that the present invention eliminates the need for the seal disc 32 taught by the prior art and shown at FIG. 3.

The airfoils 10 and 30 are concave in the direction of airflow A, and convex in the opposite direction.

Use of the static efficiency enhancer of the present invention results in improved exit air velocity profiles and static efficiencies. As shown in FIG. 8, the conventional velocity profile 12 is extended in the inner radial area at 42 to add a new cross-hatched area of additional work not available in the prior art designs.

As shown in FIGS. 6 and 8, neck 15 tapers from a large end connected to blade 15 to a small end connected to hub 16. The hub 16 is also substantially non-streamlined and flat and, as shown in FIG. 8, the leading and trailing edges of airfoil 30 may be concave. FIGS. 6, 7 and 8 illustrate how the interior of the advantageously molded airfoil 30 conforms to the outer shape of the tapered neck 15. FIG. 7 also illustrates the positioning of the airfoil 30 with respect to a central axis of the blade 14 which would be at the center of the oval cross-section of neck 15.

While specific embodiments of the invention have been shown and described in detail to illustrate the application of the principles of the invention, it will be understood that the invention may be embodied otherwise without departing from such principles.

What is claimed is:

1. A static efficiency enhancer for an axial fan having a hub and a plurality of blades extending radially outwardly from the hub, the enhancer comprising:

each blade having a neck connected to the hub;

a plurality of airfoils extending outwardly from the hub to provide additional air velocity at the periphery of the hub, each airfoil having a concave surface and an opposite convex surface;

each airfoil encircling the neck of a respective blade; and the hub being a flat disc-shape and the airfoils enlarging an area of work done with enhanced static efficiency toward the hub.

2. A static efficiency enhancer according to claim 1, wherein the neck is tapered with a large end connected to the blade and a small end connected to the hub, the airfoils each being molded and having an opening for receiving the neck.

3. A static efficiency enhancer according to claim 2, wherein each airfoil has leading and trailing concave edges.

4. A static efficiency enhancer according to claim 3, wherein the airfoils extend outwardly from the hub to about 25% to 30% of the fan diameter.

5. A method of enhancing static efficiency for an axial fan having a hub and a plurality of blades extending radially outwardly from the hub, the method comprising:

providing the hub to be in the form of a flat disc-shape;

attaching a plurality of airfoils at a location between the hub and the blades, the airfoils being shaped to provide additional air velocity at the periphery of the hub, each airfoil having a concave surface and an opposite convex surface so that an area of work done with enhanced static efficiency is enlarged toward the hub; and connecting each blade to the hub with a neck which extends between each blade and the hub, each airfoil encircling the neck of a respective blade.

6. A method according to claim 5, wherein the airfoils extend outwardly from the hub to about 25% to 30% of the fan diameter.

7. A method according to claim 6, including connecting each blade to the hub by a neck which tapers from a large end connected to the blade and a small end connected to the hub, the airfoil being molded and having an opening for receiving the neck.

8. A method according to claim 7, including forming the airfoil to have leading and trailing concave edges.

* * * * *